US006573468B2

(12) United States Patent
Sfondrini et al.

(10) Patent No.: US 6,573,468 B2
(45) Date of Patent: Jun. 3, 2003

(54) ACTUATION AND CONTROL DEVICE FOR HIGH-AND MEDIUM-VOLTAGE CIRCUIT BREAKERS

(75) Inventors: Libero Sfondrini, Lodi (IT); Enrico Elli, Verano Brianza (IT); Costante Piazza, Lodi (IT); Fabio Montelaghi, Bergamo (IT)

(73) Assignee: ABB Trasmissione & Distribuzione S.p.A., Milan (IT)

( * ) Notice: Subject to any disclaimer, the term of this patent is extended or adjusted under 35 U.S.C. 154(b) by 0 days.

(21) Appl. No.: 09/764,079

(22) Filed: Jan. 19, 2001

(65) Prior Publication Data

US 2001/0006144 A1 Jul. 5, 2001

Related U.S. Application Data

(63) Continuation of application No. PCT/EP99/05363, filed on Jul. 23, 1999.

(30) Foreign Application Priority Data

Jul. 24, 1998 (IT) ..... MI98A1730

(51) Int. Cl.[7] ..... H01H 3/32
(52) U.S. Cl. ..... 200/501; 200/48 V
(58) Field of Search ..... 200/501, 48 V, 200/485 B, 253.1

(56) References Cited

U.S. PATENT DOCUMENTS 3,171,920 A 3/1965 Klein
2,598,940 A * 8/1971 Smedley et al. ..... 200/48 SB
4,317,973 A * 3/1982 Golata ..... 200/501 X
4,357,505 A 11/1982 Bridges
4,423,336 A 12/1983 Iverson et al.
5,296,788 A 3/1994 Betton et al.
6,343,424 B1 * 11/2001 Bachofen ..... 200/48 V X

FOREIGN PATENT DOCUMENTS

EP A-0 475 247 3/1992
FR A-2 711 839 5/1995

* cited by examiner

*Primary Examiner*—Renee Luebke
(74) *Attorney, Agent, or Firm*—Guido Modiano; Albert Josif; Daniel O'Byrne

(57) ABSTRACT

An actuation and control device for opening and/or closing high- and medium-voltage circuit breakers having at least one fixed contact and at least one moving contact, comprising actuation means which are operatively connected to the moving contact and supply the energy for performing the opening/closure movement, the particularity of which consists of the fact that the actuation means comprise a servomotor, an electronic control and power supply unit, and elements for transmitting motion, and that the actuation means and/or the coupling between the fixed contact and the moving contact are such as to achieve a desired speed of the moving contact at the instant in which it separates from the fixed contact.

8 Claims, 7 Drawing Sheets

ACTUATION AND CONTROL DEVICE FOR HIGH-AND MEDIUM-VOLTAGE CIRCUIT BREAKERS

CROSS-REFERENCE TO RELATED APPLICATIONS

This application is a continuation of application number PCT/EP99/05363 filed on Jul. 23, 1999.

BACKGROUND OF THE INVENTION

The present invention relates to an actuation and control device for opening/closing switchgear, particularly circuit breakers for high- and medium-voltage transmission and/or distribution networks. The device according to the invention is now described with reference to a high-voltage circuit breaker without intending in any way to limit the scope of its application.

An example of a single pole of a high-voltage circuit breaker provided with a known type of actuation device is shown schematically in FIG. 1. A first post-shaped supporting insulator 2 is arranged on a supporting frame 1 and a second insulator 3 is arranged on the upper end of said first insulator; an interruption chamber is provided inside said second insulator and has circuit breaking mechanisms which comprise fixed contacts and moving contacts. Opening/closure is performed by engaging/disengaging the fixed contacts with respect to the moving contacts. The moving contacts are operatively connected to an actuation rod which runs, inside the supporting insulator 2, from the moving contacts to the base of the post. The rod is actuated by means of kinematic systems which are located in a housing 4 at the base of the post and are operatively connected to an actuation device 5. Actuation devices for high-voltage circuit breakers are currently of the mechanical or hydraulic type.

The mechanical actuation device generally uses two springs, namely a closure spring and an opening spring, a stroke limit damping system, a reloading motor for the closure spring and a mechanism which allows to convert the motion produced by the springs into a translatory motion of the moving contact, to reload the opening spring and to make the opening movement independent of the closure movement.

According to a known embodiment, the mechanical actuation is provided by means of the device shown in FIG. 2, in which the following elements can be identified: an opening spring 10, an opening device 11 actuated by an electromagnet, an eccentric element with a lever 12, a closure device 13 actuated by an electromagnet, a main shaft 14, an arm 15 rigidly coupled to the shaft 14, a closure spring 16, a damping unit 17, a drum 18 and a gearmotor 19.

Another example of known mechanical actuation device is described in U.S. Pat. No. 5,151,567 and is shown schematically in FIG. 3. In this case, the movement of the main shaft 20 during the opening of the circuit breaker (in the direction of the arrow 28 of FIG. 3) is produced by virtue of the action of a spring 21 which is conveniently positioned and connected to the main shaft 20 by means of the crank 22. The movement of said rod is allowed by a release mechanism 23. During closure (direction of the arrow 27 of FIG. 3), the main shaft 20 is moved by means of a motor 24 which is directly coupled to the main shaft 20 and is actuated by an electronic unit 25 supplied by the power supply block 26. The action of said motor also allows to reload the opening spring 21. Accordingly, the closure spring is eliminated and the spring 21 is used only during opening, the opening speed being preset by selecting the dimensions of the spring.

However, in the above solution there is no active control of the position and motion of the actuation shaft 20 during the opening and closure of the circuit breaker.

Many other configurations are available as an alternative to the illustrated ones, but the mechanical actuation devices of the known art generally have a large number of components which require a long and complicated initial calibration. Despite performing the task to which they are dedicated, these devices have several drawbacks in addition to their already-mentioned mechanical complexity. The movement of the moving contact is in fact determined exclusively by the elastic characteristic of the opening and closure springs: the rule of motion of the moving contact cannot be changed by the user but is set during design. Actuation devices of the hydraulic type, in which the movement of the moving contact is ensured by suitable hydraulic actuators, can partially obviate these drawbacks, but they have disadvantages linked to the presence of fluids, especially owing to their temperature-sensitivity.

The use of springs and the lack of control over the rule of motion of the actuator furthermore require the presence of damping elements or shock-absorbers in order to dissipate the residual kinetic energy at the end of the movement and to avoid uncontrolled impacts against the pole. Moreover, precision in the positioning of the moving contact is limited by a mechanism which is inherently inaccurate owing to the presence of the springs.

The energy that must be supplied is furthermore greater than the energy strictly necessary to move the moving contact, since it is also necessary to move the various mechanical elements of the actuation device.

SUMMARY OF THE INVENTION

The aim of the present invention is to provide an actuation and control device for high- and medium-voltage circuit breakers (i.e. for voltages greater than 1000 V) which allows to move the moving contact of said circuit breaker according to a predetermined rule of motion.

Within the scope of this aim, an object of the present invention is to provide an actuation and control device for high- and medium-voltage circuit breakers whose mechanical complexity is reduced.

Another object of the present invention is to provide an actuation and control device for high- and medium-voltage circuit breakers which allows to preset the positioning precision of the moving contact both during opening and during closure.

Another object of the present invention is to provide an actuation and control device for high- and medium-voltage circuit breakers which ensures repeatability of the movement, optionally compensating variations due to aging and wear.

Another object of the present invention is to provide an actuation and control device for components of high- and medium-voltage circuit breakers which has reduced response times.

Another object of the present invention is to provide an actuation and control device for components of high- and medium-voltage circuit breakers which is highly reliable, relatively easy to manufacture and at competitive costs.

Thus, the present invention relates to an actuation and control device for opening and closing high- and medium-voltage circuit breakers having at least one fixed contact and at least one moving contact, said device comprising actuation means which are operatively connected to the moving contact and supply the energy for performing the opening/closure movement. The device according to the present invention is characterised in that said actuation means comprise a servomotor, an electronic control and power supply unit for driving said motor, and elements for transmitting motion between the motor and the moving contact, and it is further characterised in that said actuation means and/or the coupling between the fixed contact and the moving contact are such as to achieve a desired speed of the moving contact at the instant in which it separates from the fixed contact during the opening movement.

The device according to the invention, in addition to ensuring a desired speed of the moving contact at the instant in which the contacts separate, is furthermore capable of controlling the rule of motion during the entire opening and/or closure movement.

Control of the speed of the moving contact at the instant in which it separates from the fixed contact allows to optimize the quenching times of the electric arc between the contacts.

Control of the rule of motion of the moving contact allows to ensure the accuracy and repeatability of the movement. The actuation device is furthermore highly simplified with respect to known types of actuation system, since it allows to eliminate springs of the spiral or other type, the motor for reloading the closure spring, and all the mechanisms that allow to perform the movement cycle; accordingly, the space occupation is also reduced. Furthermore, as a consequence of constructive simplicity, the need for maintenance interventions is reduced.

The elements for transmitting motion between the motor and the moving contact and the coupling between the moving contact and the fixed contact furthermore ensure the movement of said moving contact at a desired speed without this entailing an oversizing of the servomotor. The term servomotor is generally used to define motors having a feedback control system.

BRIEF DESCRIPTION OF THE DRAWINGS

Further characteristics and advantages of the invention will become apparent from the description of some preferred but not exclusive embodiments of an actuation and control device for opening and/or closing high- and medium-voltage circuit breakers, illustrated only by way of non-limitative example in the accompanying drawings, wherein.

DESCRIPTION OF THE PREFERRED EMBODIMENTS

Figure 2:
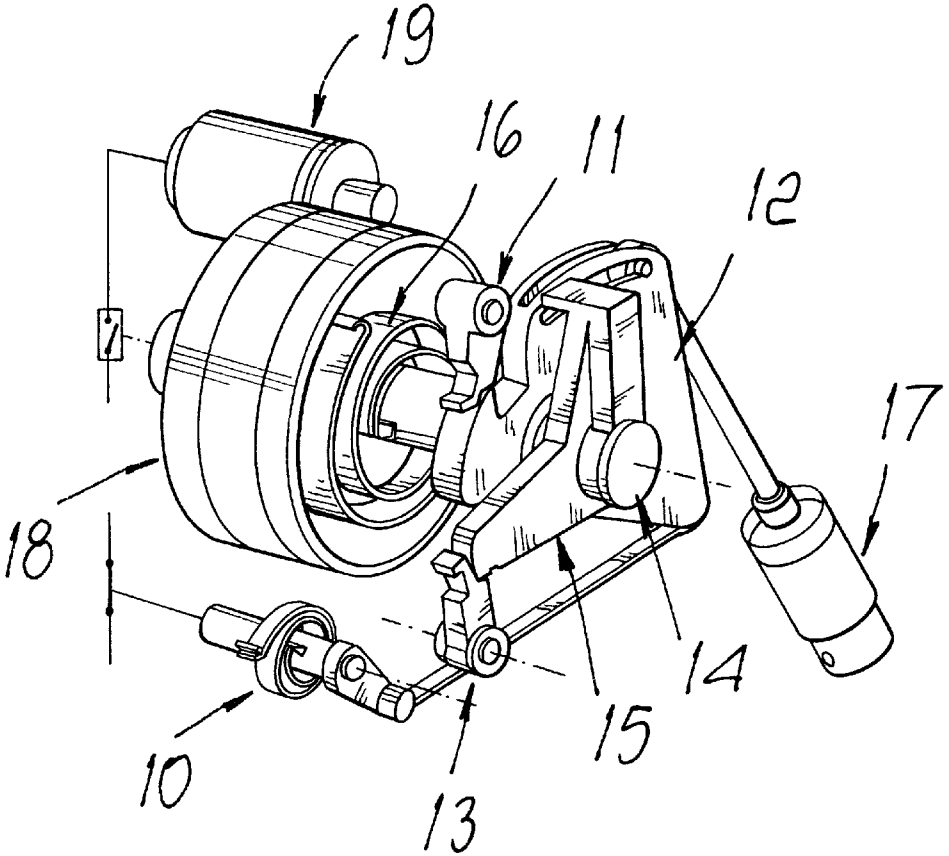
FIG. 2 PRIOR ART
FIG. 2 is a schematic view of an example of a mechanical actuation device of a known type.
Figure 1:
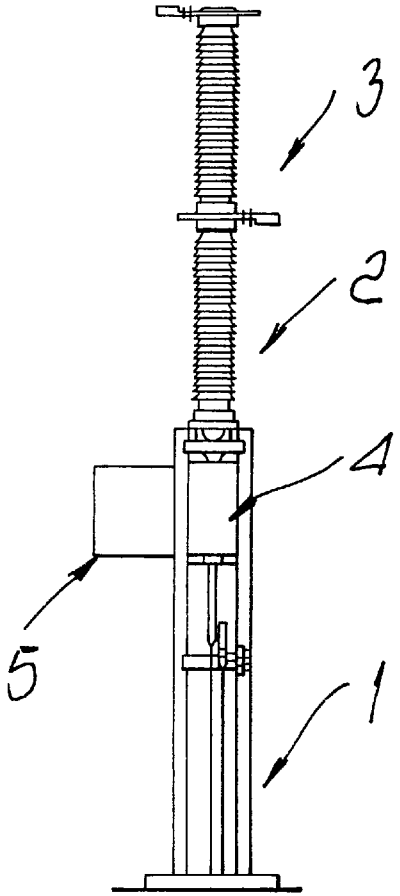
FIG. 1 PRIOR ART
FIG. 1 is a schematic view of a pole of a circuit breaker provided with an actuation device of a known type.
Figure 3:
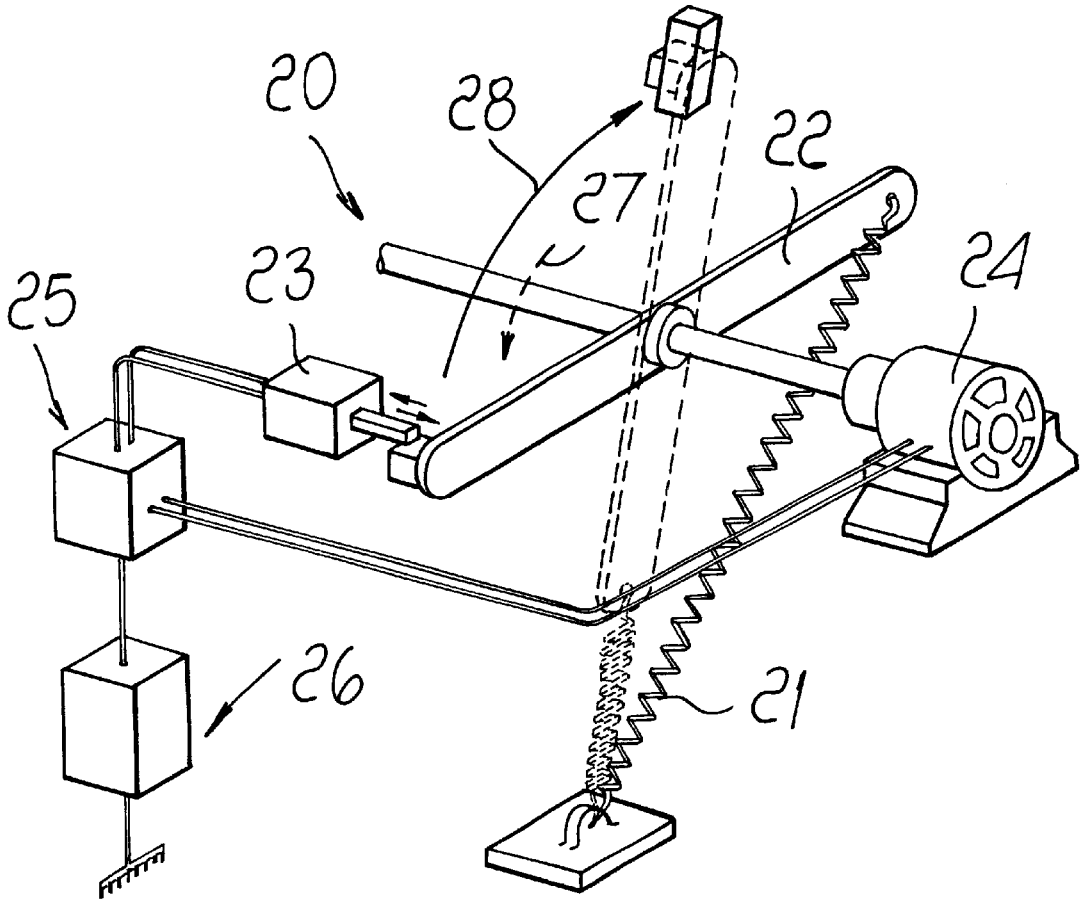
Fig. 3 PRIOR ART
FIG. 3 is a schematic view of another example of a mechanical actuation device of a known type.
Figure 4:
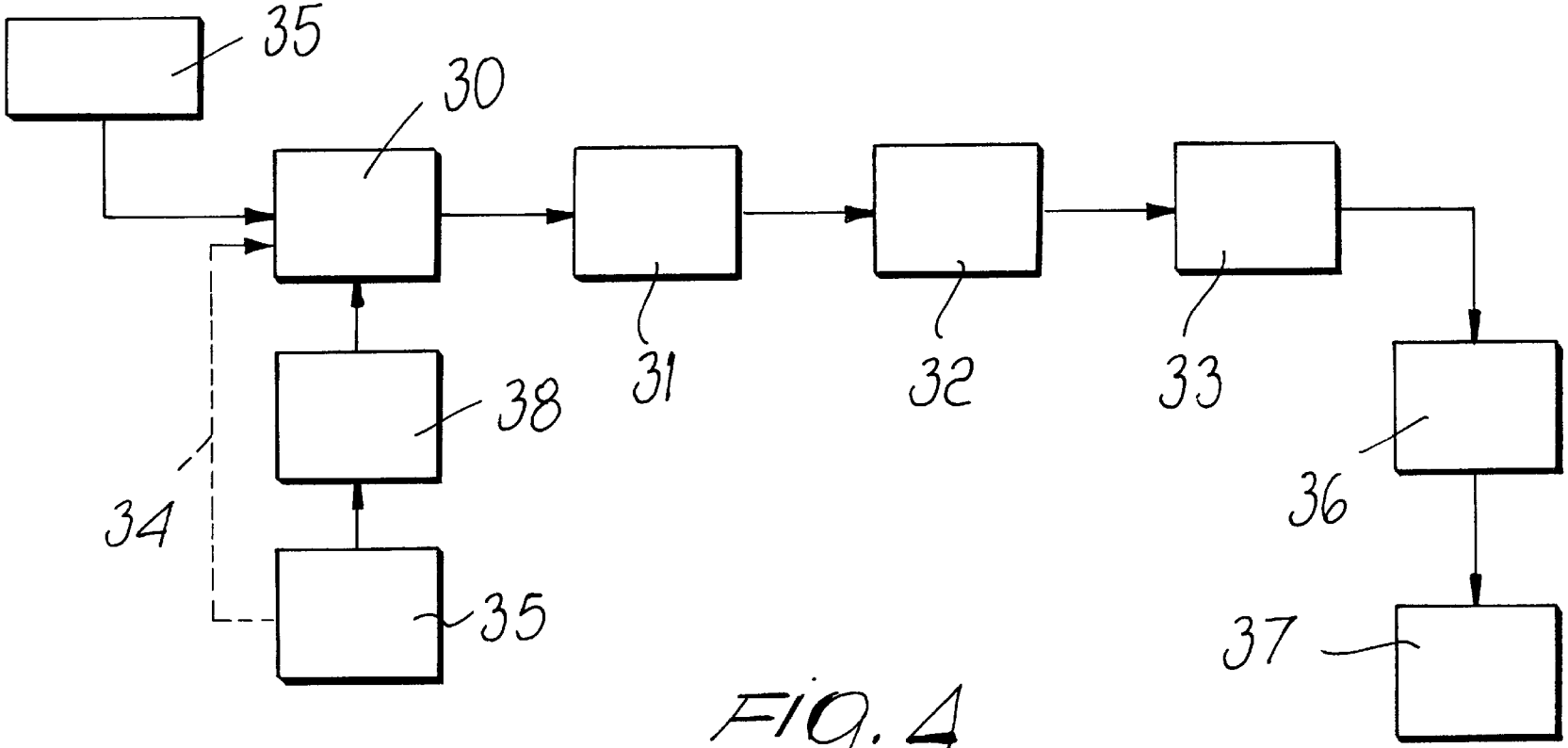
FIG. 4 is a block diagram of an actuation and control device according to the invention.

With reference to FIG. 4, the actuation and control device according to the invention comprises a control and power supply unit 30 which, as a consequence of an intervention command 35 (which originates for example from an operator or from a protection system), actuates a servomotor 31 which is operatively connected to a moving contact 33 of the circuit breaker by virtue of suitable motion transmission elements 32. The moving contact 33 is coupled to a fixed contact 37 by means of a suitable coupling system 36. The servomotor 31 is driven by the unit 30 so that the moving contact 33 obeys a preset rule of motion. Furthermore, by virtue of the action of the motor and of the structure of the motion transmission elements 32 and/or of the coupling 36, it is possible to achieve a chosen speed of the moving contact 33 at the instant in which it separates from the fixed contact 37 during the opening movement.

The control and power supply unit 30 can generally be supplied directly by the network 34, but it is preferably powered by an energy accumulation system 38, for example a bank of capacitors, and acts on the servomotor 31. The use of a servomotor allows to have considerable power available with short delivery times. It is furthermore possible, power levels being equal, to act with two independent control parameters (torque and/or speed), allowing greater flexibility during design.

Furthermore, the use of motion transmission elements 32 which have an appropriate structure and/or the adoption of a suitable coupling 36 between the moving contact 33 and the fixed contact 37 allow to optimize the scaling of said servomotor, achieving the chosen speed of the moving contact during the opening movement without thereby requiring an excessive power on the part of the servomotor. This allows a further reduction in the manufacturing costs of the device according to the invention.

Some nonlimitative examples of possible embodiments of said elements for transmitting motion between the servomotor and the moving contact are shown schematically in FIGS. 5 to 9.

In a first embodiment of the device according to the invention, the elements for transmitting motion between the servomotor and the moving contact are provided so that for an initial period after the opening command the movement applied by the servomotor 31 is not transmitted to the moving contact 33.

Figure 5:
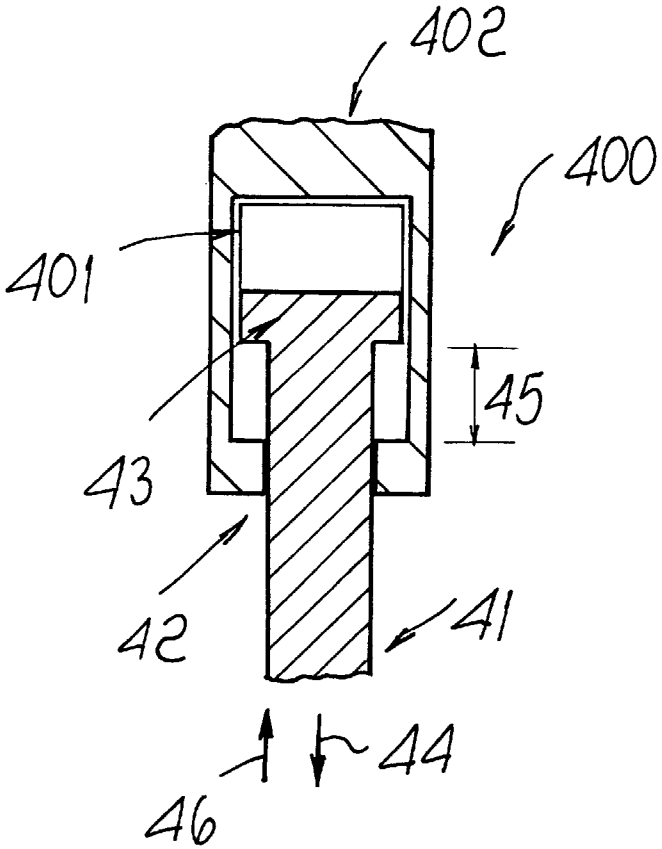
FIG. 5 is a view of an example of a first embodiment, according to the invention, of elements for transmitting motion between the motor and the moving contact.

With reference to FIG. 5, the guiding rod of the moving contact 402 is constituted at least partially by a sleeve 400 inside which a rod 41 can move freely; said rod is connected to the main actuation shaft. When the opening command occurs, the main actuation shaft, connected to the servomotor 31, causes the rod 41 to slide in the direction indicated by the arrow 44. After traveling the distance 45 indicated in the figure, the rod 41, by virtue of a raised portion 43 formed thereon, engages the rod 402 at the edge 42 of the sleeve 400. In this manner, the rod 402 and therefore the moving contact 33 of the circuit breaker are moved monolithically in the direction indicated by the arrow 44.

During the closure of the circuit breaker, the main actuation shaft, connected to the servomotor 31, actuates the rod 41 in the direction of the arrow 46 until the raised portion 43 abuts against the rod 402.

Suitable damping means can be introduced in order to make the contact between the rod 41 and the rod 402 more gradual. FIG. 5 shows, for the sake of simplicity, an example of said damping means, constituted by a pad 401 which is interposed between the rod 41 and the rod 402. Alternative embodiments may also provide for the interposition of said damping pad 401 also between the raised portion 44 of the rod 41 and the edge 42 of the sleeve 400.

The embodiment of FIG. 5 is advantage in that during the opening of the circuit breaker the moving contact begins its separation from the fixed contact with a nonzero initial speed. If the geometry of the moving contact and of the fixed contact is known, it is possible to set the dimensions of the gap 45 so that the moving contact has a preset speed at the instant in which it separates from the fixed contact.

Figure 6:
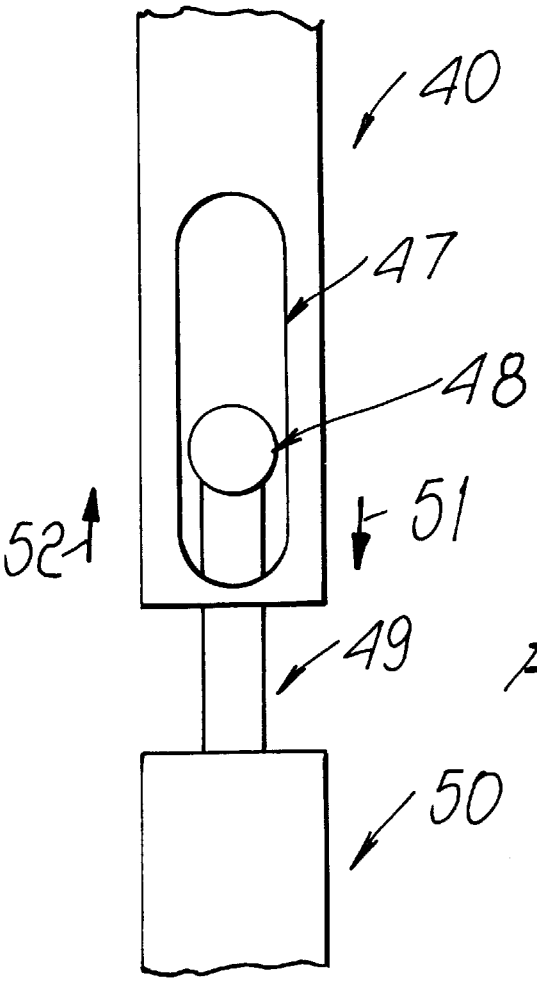
FIG. 6 is a view of another example of an embodiment, according to the invention, of elements for transmitting motion between the motor and the moving contact.

Another example of an embodiment of elements for transmitting motion between the servomotor and the moving contact, using the same principle as in FIG. 5, is presented with reference to FIG. 6. In this case, a slot 47 is formed in the guiding rod 40 of the moving contact and a pivot 48 slides therein; said pivot is connected, by means of the support 49, to the rod 50 which is connected to the main actuation shaft, which is in turn actuated by the servomotor. The slot 47 can be a through slot, as shown in FIG. 6. As an alternative, the coupling between the rod 40 and the pivot 48 can be provided by means of a suitable slot formed on the outer surface of the rod 40.

During the opening movement, the main actuation shaft causes the sliding of said pivot 48 in the direction of the arrow 51 over the entire length of the slot 47. At the end of the stroke along said slot 47, the pivot 48 engages the rod 40, causing the moving contact connected to said rod 40 to move with a nonzero initial speed. As in the embodiment described in the preceding case, if the geometry of the moving contact and of the fixed contact is known, it is possible to set the dimensions of the slot 47 so that the moving contact has a preset speed at the instant in which it separates from the fixed contact.

During the closure movement, the rod 50 is moved by the main shaft in the direction of the arrow 52, moving the pivot 48 into abutment at the opposite end of the slot 47. In this manner, the rod 40 moves rigidly with the rod 50 until the circuit breaker closes completely.

As in the case of FIG. 5, the use of damping systems can be provided for this embodiment also.

In another embodiment of the device according to the invention, the elements for transmitting motion between the servomotor and the moving contact are provided so as to form a variable motion transmission ratio.

Figure 7:
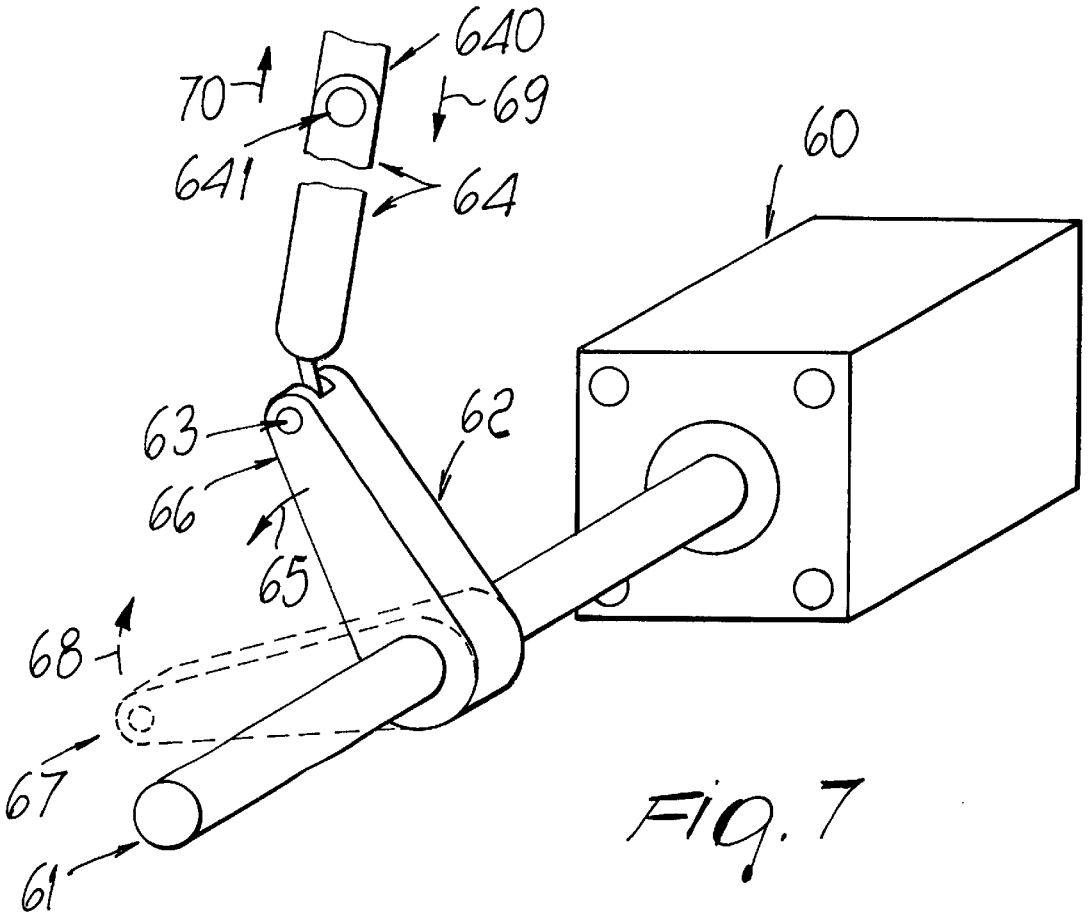
FIG. 7 is a view of another example of an embodiment, according to the invention, of elements for transmitting motion between the motor and the moving contact.

According to the embodiment shown in FIG. 7, a crank 62 is connected to the main actuation shaft 61, which is actuated by the servomotor 60; said crank is in turn connected to the linkage 64 by means of the pivot 63. The linkage 64 is in turn connected to the guiding rod of the moving contact 640 by means of an articulation 641. The crank 62 and the linkage 64 allow to convert the rotary motion of the main shaft 61 into a translatory motion of the guiding rod of the moving contact 640. During the opening movement, the main shaft rotates in the direction of the arrow 65 and the crank 62 moves from an inactive position 66 to a subsequent position 67. Owing to the very dynamics of the rotation of the crank 62, the movement of the guiding rod of the moving contact 640 in the direction of the arrow 69 occurs initially at a reduced speed. Then the translatory speed of the guiding rod of the moving contact 640 increases considerably, again because of the rotational dynamics of the crank 62. Accordingly, by scaling the crank 62 and the linkage 64 appropriately it is possible to make the moving contact separate from the fixed contact with the chosen speed.

During the closure movement, the servomotor 60 turns the main actuation shaft 61 in the direction of the arrow 68, rotating the crank 62 from the position 67 to the position 66 and therefore moving the guiding rod of the moving contact 640 in the direction of the arrow 70, which is the opposite of the preceding one.

Figure 8:
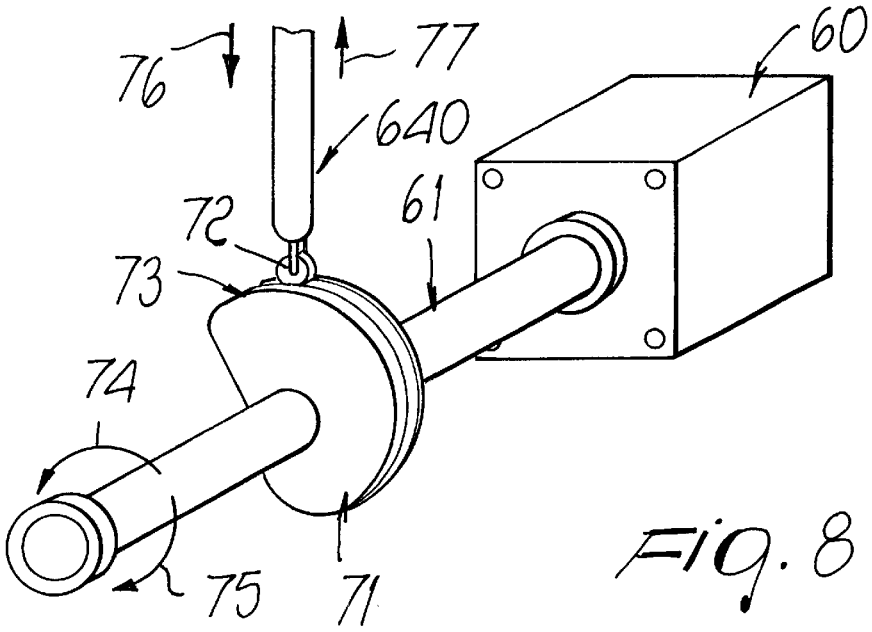
FIG. 8 is a view of another example of an embodiment, according to the invention, of elements for transmitting motion between the motor and the moving contact.

According to the embodiment shown in FIG. 8, a cam or eccentric element 71 is connected to the main actuation shaft 61. The guiding rod of the moving contact 640 is connected to the cam 71 by means of a roller 72 which can slide freely in a slot 73 formed proximate to the edge of the cam 71. During the opening movement of the circuit breaker, the servomotor 60 causes a rotation of the main shaft 61 in the direction of the arrow 74. By virtue of the presence of the roller 72 and of the cam 71, the rotary motion of the shaft 61 is converted into a translatory motion of the guiding rod 640 in the direction of the arrow 76. This movement, by virtue of the very geometry of said cam 71, occurs initially at a reduced speed and then at an increasing speed. As in the embodiment of FIG. 7, it is possible to scale the cam 71 so that the moving contact of the circuit breaker has a preset translatory speed in the direction of the arrow 76 at the instant in which it separates from the fixed contact. During the closure movement, the servomotor 60 rotates the main shaft 61 in the direction of the arrow 75. The rotation of the cam 71 and the consequent motion of the roller 72 along the slot 73 causes a translatory motion of the guiding rod 640 in the direction of the arrow 77.

Figure 9:
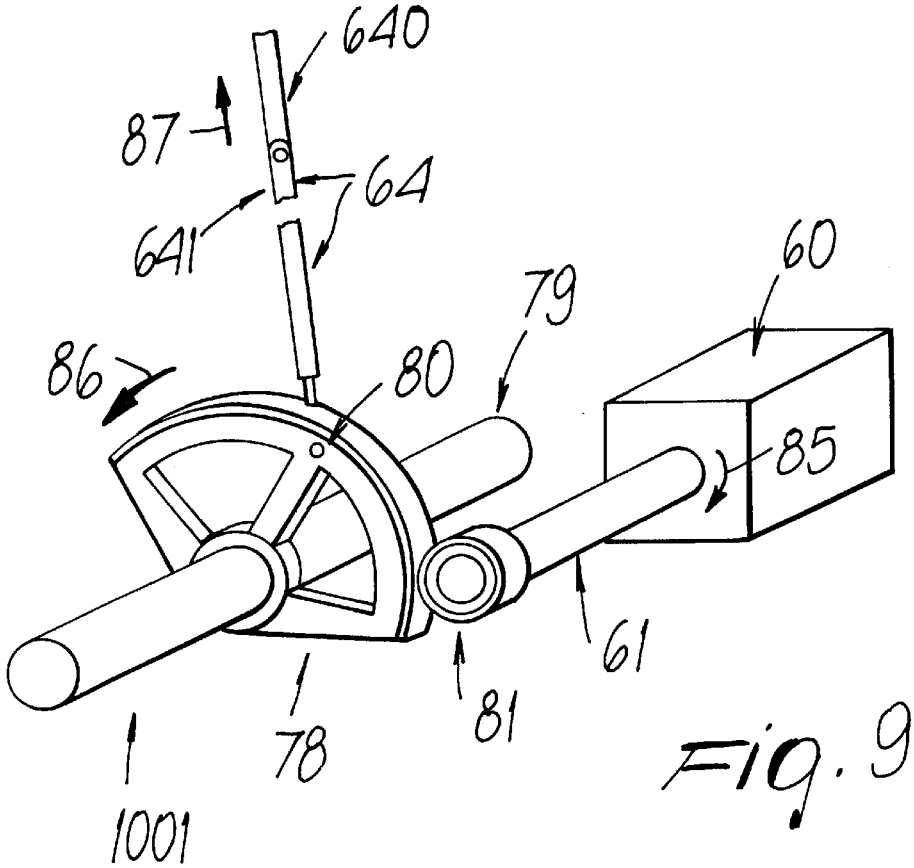
FIG. 9 is a view of another example of an embodiment, according to the invention, of elements for transmitting motion between the motor and the moving contact.
Figure 10:
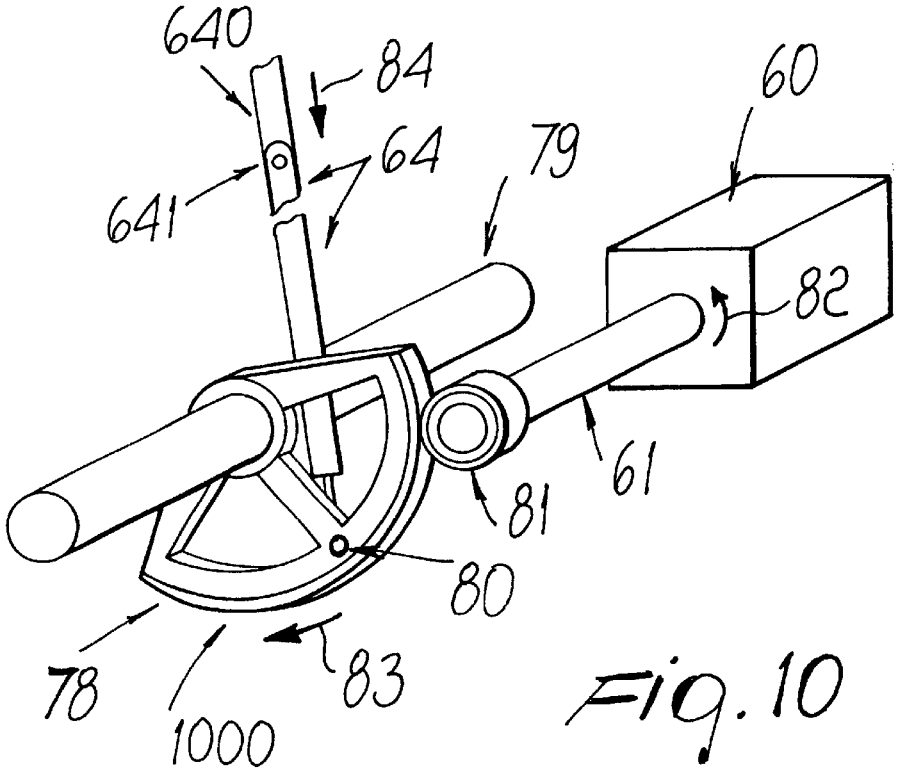
FIG. 10 is a view of the same embodiment of FIG. 9 in another movement position.

According to the embodiment shown in FIGS. 9 and 10, a gear 78 is arranged on a secondary shaft 79. The gear 78 is connected to the linkage 64 by means of the pivot 80. The linkage 64 is in turn connected to the guiding rod 640 of the moving contact by means of the articulation 641. The gear 78 is furthermore connected to the main shaft 61, actuated by the servomotor 60, by means of the pinion 81.

During the opening of the circuit breaker, the servomotor 60 turns the main shaft 61 in the direction of the arrow 82 shown in FIG. 10; by virtue of the pinion 81, the gear 78 is turned in the direction of the arrow 83; this fact produces the translatory motion of the guiding rod of the moving contact 640 in the direction of the arrow 84. The gear therefore assumes the position 1000 of FIG. 10. By appropriately scaling the pinion 81 and the gear 78 and appropriately choosing the position of the pivot 80 on the gear 78 it is possible to make the translatory motion of the guiding rod of the moving contact 640 in the direction of the arrow 84 occur with the chosen speed at the instant in which the moving contact separates from the fixed contact. During the closure movement, the servomotor 60 turns the main shaft 61 in the direction of the arrow 85 of FIG. 9. This produces a rotation of the gear 78 in the direction of the arrow 86, with a consequent translatory motion of the guiding rod 640 of the moving contact in the direction of the arrow 87. The gear therefore assumes the position 1001 of FIG. 9.

This embodiment appears to be particularly advantageous, since it has an additional parameter to work on for the overall scaling of the system, namely the transmission ratio between the pinion and the gear.

Figure 11:
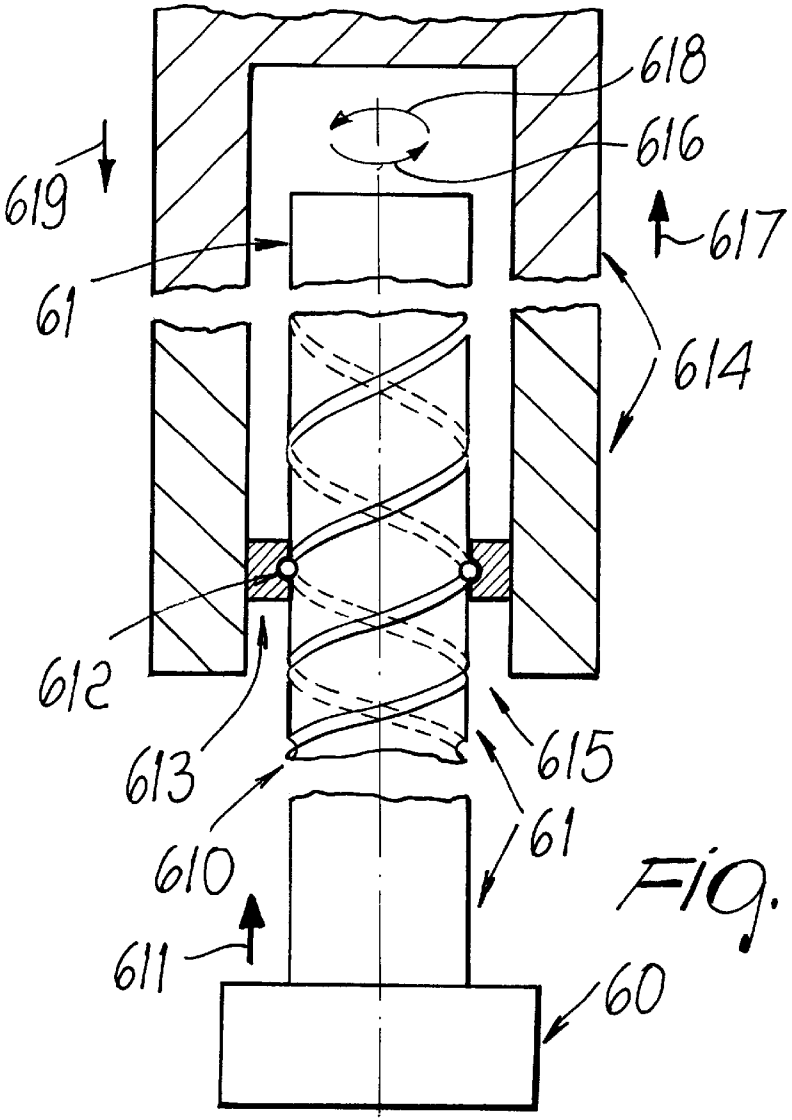
FIG. 11 is a view of another example of an embodiment, according to the invention, of elements for transmitting motion between the motor and the moving contact.

FIG. 11 schematically illustrates another embodiment of elements for transmitting motion between the servomotor and the moving contact. According to this embodiment, the servomotor 60 is arranged along the same directrix of motion as the moving contact of the circuit breaker (for example vertically).

The servomotor 60 is connected to the main actuation shaft 61, which has, along a certain portion of its length, one or more surface grooves 610 which are arranged on a helical path in the direction of the axis of the shaft 61 and have a variable pitch. In particular, the pitch of said slots 610 increases in the direction indicated by the arrow 611. Inside each groove there is a ball 612 which is connected, by means of a carriage 613, to the actuation rod of the moving contact 614, which is machined so as to have a cylindrical seat 615 which is suitable to accommodate the actuation shaft 61 over a certain portion of its length.

During the closure movement, the servomotor 60 turns the actuation shaft 61 in the direction of the arrow 616. The ball 612 is forced to move along the grooves 610 and by virtue of the carriage 613 it induces a translatory motion of the rod 614 in the direction of the arrow 617. During the opening movement, the servomotor 60 turns the shaft in the direction 618 and induces a translatory motion of the rod 614 in the direction indicated by the arrow 619. By virtue of the variable pitch of the groove 610, this movement occurs at a variable speed. By appropriately scaling said pitch of the groove 610, the rod 614, the shaft 61 and the servomotor 60, the moving contact can be made to have a preset speed at the instant in which it separates from the fixed contact.

Figure 12:
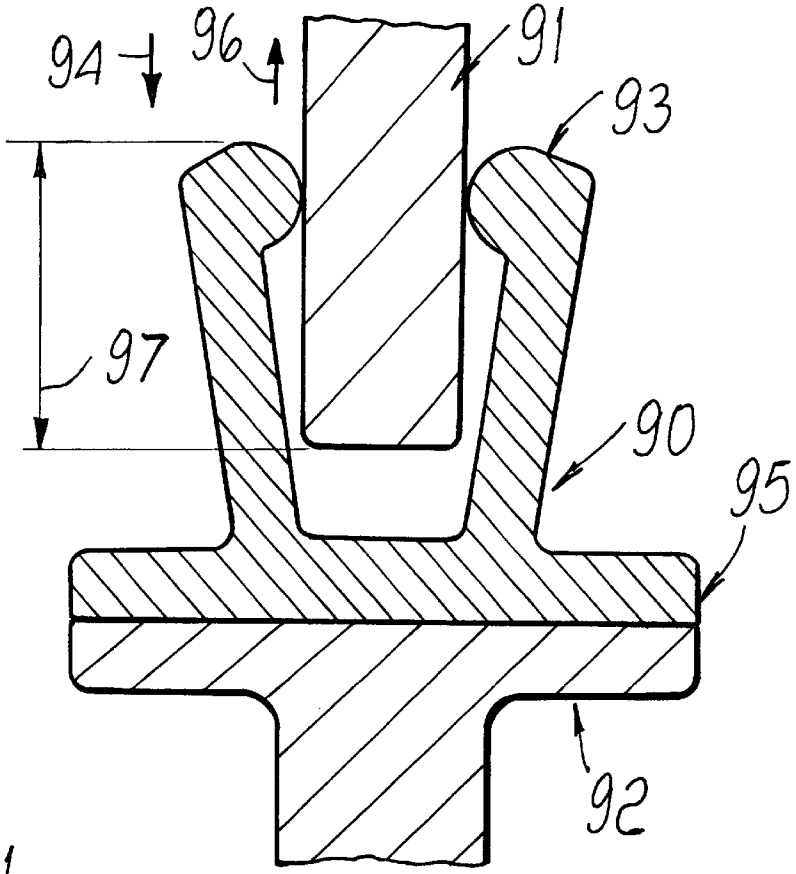
FIG. 12 is a schematic view of an example of embodiment of the coupling between the fixed contact and the moving contact of the circuit breaker according to the invention.

In addition and/or as an alternative to the choice and optimization of the elements for transmitting motion between the servomotor and the moving contact of the circuit breaker, the speed with which the moving contact separates from the fixed contact can be preset by means of an appropriate selection and scaling of the system for coupling the fixed contact and the moving contact. A non-limitative schematic example of a possible embodiment of the coupling between the fixed contact and the moving contact is shown in FIG. 12. In particular, a coupling between the fixed contact and the moving contact according to a so-called tulip structure is shown.

During the closure movement, the fixed contact 91 is inserted in a tubular structure 90 (that is to say, the moving contact moves in the direction of the arrow 96) which is connected to a guiding rod 92 by means of a flange 95. The electrical contact between the two structures occurs by virtue of a mechanical interference between the fixed contact 91 and the internal surface of said tubular structure 90, which is conveniently shaped with a flared guiding portion at one of its ends 93.

During the opening movement, the moving contact slides on the surface of the fixed contact in the direction of the arrow 94, maintaining the continuity of the electrical contact over the entire length 97.

By appropriately scaling said length 97 according to the power delivered by the servomotor and to the type of the elements for transmitting motion between the servomotor and the moving contact, it is possible to accelerate the moving contact 90 so that at the end of said stroke 97, that is to say, at the instant in which said moving contact separates from the fixed contact 91, said moving contact has the intended speed.

The speed at contact separation time is calculated so as to optimize the quenching time of the electric arc that forms between the fixed contact 91 and the moving contact 90 after their separation.

In practice it has been found that the actuation and control device according to the invention fully achieves the intended aim, since it allows to improve the characteristics of the electrical actuation elements by controlling the rule of motion of the moving contact and ensuring that said moving contact has a preset speed at the instant in which it separates from the fixed contact.

It has furthermore been observed that the transmission elements as described by way of example in FIGS. 5–11 and the coupling between the moving contact and the fixed contact as described by way of example in FIG. 12 allow the separation of the moving contact from the fixed contact to occur with the chosen speed during the opening movement without thereby oversizing the servomotor.

In addition to the above listed advantages, the actuation and control device allows to reduce costs by reducing the parts, by reducing the calibration operations and by eliminating movements and stresses which can lead to impact damage. Maintenance costs are also reduced accordingly.

The device thus conceived is susceptible of numerous modifications and variations, all of which are within the scope of the inventive concept; all the details may furthermore be replaced with technically equivalent elements. In practice, the materials used, so long as they are compatible with the specific use, as well as the dimensions, may be any according to the requirements and the state of the art.

What is claimed is:

1. An actuation and control device for opening and closing high- and medium-voltage circuit breakers having at least one fixed contact and at least one moving contact, said device comprising actuation means which are operatively connected to the moving contact and supply the energy for performing an opening/closure movement, wherein said actuation means comprise a servomotor having a feedback control system driven by an electronic control and power supply unit, and elements for transmitting motion between the servomotor and the moving contact, and wherein at least one of said actuation means and a coupling between the fixed contact and the moving contact are such as to achieve a chosen speed of the moving contact at a time in which it separates from the fixed contact.

2. The actuation and control device according to claim 1, wherein the electronic control and power supply unit is powered by an energy accumulation system.

3. The actuation and control device according to claim 1, wherein the elements for transmitting motion between the servomotor and the moving contact are provided so that the movement applied by the servomotor is not transmitted to the moving contact for an initial period after an opening or closure command.

4. The actuation and control device according to claim 1, wherein said elements for transmitting motion between the servomotor and the moving contact are provided so as to generate a variable motion transmission ratio.

5. The actuation and control device according to claim 4, wherein said elements for transmitting motion are constituted by a main actuation shaft connected to the servomotor, by a cam which is rigidly coupled thereto and by a rod for guiding the moving contact which is connected to said cam.

6. The actuation and control device according to claim 4, wherein the elements for transmitting motion are constituted by a main actuation shaft connected to the servomotor, by a pinion and by a gear which are respectively connected to said main actuation shaft and to a secondary shaft, and by a moving contact guiding rod which is connected to said gear by means of a linkage.

7. The actuation and control device according to claim 1, further comprising a tulip-type structure for mutually coupling the fixed contact and the moving contact.

8. A high- and medium-voltage circuit breaker, comprising the actuation and control device according to claim 1.

* * * * *